US006696632B2

(12) United States Patent
Minakuchi et al.

(10) Patent No.: US 6,696,632 B2
(45) Date of Patent: Feb. 24, 2004

(54) ELECTRIC STRINGED MUSICAL INSTRUMENT HAVING FRAME BODY AND PERCUSSION UNIT

(75) Inventors: Kiyoshi Minakuchi, Shizuoka (JP); Akio Naniki, Shizuoka (JP); Katsuya Suzuki, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 10/299,209

(22) Filed: Nov. 19, 2002

(65) Prior Publication Data

US 2003/0131721 A1 Jul. 17, 2003

(30) Foreign Application Priority Data

Nov. 19, 2001 (JP) ..... 2001-352961

(51) Int. Cl.[7] ..... G01H 1/06
(52) U.S. Cl. ..... 84/735; 84/290
(58) Field of Search ..... 84/735, 743, 290, 84/291

(56) References Cited

U.S. PATENT DOCUMENTS

| | | | | | |
|---|---|---|---|---|---|
| 3,375,747 | A | * | 4/1968 | Posey | 84/453 |
| 3,743,751 | A | * | 7/1973 | Ibanez | 84/741 |
| 4,867,028 | A | * | 9/1989 | Jones | 84/735 |
| 5,105,711 | A | * | 4/1992 | Barnard | 84/744 |
| 5,121,668 | A | * | 6/1992 | Segan et al. | 84/646 |
| 5,403,972 | A | * | 4/1995 | Valentine, Sr. | 84/730 |
| 5,434,350 | A | * | 7/1995 | Haney et al. | 84/743 |
| 5,900,573 | A | * | 5/1999 | Barnes | 84/746 |
| 5,929,362 | A | * | 7/1999 | Oteyza | 84/743 |
| 5,990,397 | A | * | 11/1999 | Taylor | 84/327 |
| 6,031,176 | A | * | 2/2000 | Tanaka | 84/735 |
| 6,255,565 | B1 | * | 7/2001 | Tamura | 84/275 |
| 6,369,304 | B1 | * | 4/2002 | Tucker | 84/291 |
| 6,441,293 | B1 | * | 8/2002 | LaBarbera | 84/723 |

FOREIGN PATENT DOCUMENTS

| | | |
|---|---|---|
| DE | 195 40 668 A1 | 5/1997 |
| JP | 7-129178 | 5/1995 |
| JP | 2000-267668 | 9/2000 |

OTHER PUBLICATIONS

English Abstract of JP 2000–267668.
English Abstract of JP 07–129178.
Copy of front page of U.S. Trademark Reg. No. 2,401,468.
Copy of Comments regarding Abstract of JP 2000–267668, JP 07–129178, U.S. Trademark Reg. No. 2,401,468 and DE 195 40668 A1.

* cited by examiner

*Primary Examiner*—Jeffrey Donels
(74) *Attorney, Agent, or Firm*—Dickstein, Shapiro, Morin & Oshinsky, LLP

(57) ABSTRACT

An electric percussion unit and small-sized speakers are detachably connected to a trunk of an electric frame guitar, and a circuit board, on which electric circuit components required for generating tones and percussion sound are mounted, and a battery unit are housed in the trunk; while a guitarist is playing a flamenco on the electric frame guitar, the guitarist beats the percussion unit with his or her hand or finger nails, and the guitar tones and percussion sound are radiated from the small-sized speakers; the electric frame guitar system is available for a wide variety of music genres, and the portability is enhanced.

24 Claims, 5 Drawing Sheets

ELECTRIC STRINGED MUSICAL INSTRUMENT HAVING FRAME BODY AND PERCUSSION UNIT

FIELD OF THE INVENTION

This invention relates to an electric stringed musical instrument and, more particularly, to an electric stringed musical instrument of the type having a frame body and an electric stringed musical instrument system including an electric stringed musical instrument and a sound generating system.

DESCRIPTION OF THE RELATED ART

Electric guitars belong to the electric stringed musical instrument. Players usually sling the electric guitars over their shoulders with straps, and pluck the strings so as to give rise to vibrations of the strings. The vibrations of the strings are converted to electric signals by means of pickup units, and the electric tones are radiated from the associated sound systems.

Various sorts of electric guitars have been proposed and sold in the market. Electric guitars with solid bodies have been popular to the guitarists. The electric guitars have solid bodies, and necks project from the solid bodies. Strings are stretched over the necks, and the pickup units are provided under the strings. The solid body is made from a wood panel or of synthetic resin, and silver fir or spruce is preferable for the solid body. Although several sorts of solid bodies are formed with hollow spaces, the hollow spaces are not expected to serve as resonators, because the amplifiers increase the loudness of the electric tones.

Nevertheless, some electric guitars have bodies formed with resonators, and are called as "electric acoustic guitar". The non-solid body is fabricated from deck boards and a sideboard. The deck boards and sideboard define the resonator, and a center block of maple reinforces the non-slid body.

The electric guitars are equipped with electromagnetic pickup units, and the electromagnetic pickup units convert the vibrations of steel strings to the electric signals. Pressure-sensitive pickup units may be employed in other electric guitars. In this instance, nylon strings or gut strings may extend over the pressure-sensitive pickup units.

Thus, various sorts of bodies, pickup units and strings result in a wide variety of electric guitars. As described hereinbefore, the resonators are not required for the electric guitars with the exception of the electric acoustic guitars. Frame bodies have been proposed for the electric guitars. The frame bodies are so light that guitarists feel the electric guitars easy to keep them around the waists.

FIG. 1 shows a typical example of the electric guitar 1. The prior art electric guitar 1 comprises a frame body 2, a trunk 3 and strings 4. The trunk 3 serves as a boss 3*a* and a neck 3*b*. The frame body 2 is separable into three frame pieces 2*a*, 2*b* and 2*c*, and the frame piece 2 and pieces 2*b*/2*c* sideward project from the both side surfaces of the boss 3*a*. A fingerboard 5 is adhered to the upper surface of the neck 3*b*, and frets 6 are embedded in the finger-board 5 at intervals. The strings 4 are made of nylon, and are stretched over the frets 6. A peg box 7 are fixed to the boss 3*a*, and pegs 8 are rotatably supported by the peg box 7. The strings 4 are wound on the pegs 8, and bridges 9 and 10 make the strings 6 floating over the frets 6. A pickup unit is provided between the upper surface of the trunk 3*a* and the bridge 10, and converts the vibrations to an electric signal. The electric signal is electrically amplified, and is converted through a speaker system to sound. Thus, the vibrations of strings are magnified without any mechanical resonator.

The frame pieces 2*a*, 2*b* and 2*c* make users to image the outline of the conventional guitar body. The frame pieces 2*b* and 2*c* are connected to the left side of the trunk 3, and the other frame piece 2*a* is connected to the right side of the trunk 3. The frame bodies 2*a*/2*b*/2*c* are detachable from the trunk 3*a*. The detachable frame body 3 is desirable for users, because they package the trunk 3 and frame body in a small case. The electric guitars with frame bodies are hereinbelow referred to as "electric frame guitars".

The frame body 2 is so light and easy for packaging that the manufacturers supply various models of frame guitars to the music market. Many pop musicians and rockers give their performances on the frame guitars to the music fans. However, the prior art frame guitars are not available for some music genres. For example, while a guitarist is performing a piece of flamenco music, the guitarist not only plucks the strings but also beats the body. Spanish guitars are used in the performance, and have resonators in the bodies. When the guitarist beats the body, the resonator enlarges the beats, and the melody and rhythm make the flamenco music impressive. Thus, the beats are unique feature of the flamenco. This means that the prior art electric frame guitars are useless, because there is not any board to be beaten. Moreover, even if a board is attached to the frame body 2, the beats are not enlarged, and the guitar sound drowns out the beats.

Another problem inherent in the prior art electric frame guitar is portability of the electric guitar system. When a guitarist practices the prior art electric frame guitar, the guitarist is to connect the pickup unit through a cable to amplifiers, to which a speaker system is to be connected through a cable. When he or she moves to another studio, he or she disconnects the prior art electric frame guitar from the amplifiers and the amplifiers from the speaker system, and conveys the amplifiers and speaker systems to the studio together with the prior art electric frame guitar.

SUMMARY OF THE INVENTION

It is therefore an important object of the present invention to provide an electric stringed musical instrument available for the music genres requiring beats as well as tones.

It is also an important object of the present invention to provide an electric stringed musical instrument system, which is compact and portable.

In accordance with one aspect of the present invention, there is provided an electric stringed frame musical instrument for generating electric tones comprising a trunk having a surface, at least one string connected at both end portions thereof to the trunk and stretched over the surface, a frame body connected to the trunk, a pickup unit provided under the aforesaid at least one string and converting vibrations of the aforesaid at least one string to a first electric signal representative of electric tones to be generated, and an electric percussion unit connected to the trunk and beaten for generating a second electric signal representative of percussion sound to be generated. In accordance with another aspect of the present invention, there is provided an electric stringed frame musical instrument for generating electric tones comprising a trunk having a surface, at least one string connected at both end portions thereof to the trunk and stretched over the surface, a frame body detachably connected to the trunk, a pickup unit provided under the aforesaid at least one string and converting vibrations of the aforesaid at least one string to an electric signal representative of electric tones to be generated, and a signal processing system provided inside of the trunk, connected to the pickup unit for receiving the electric signal and including a speaker detachably connected to the trunk for radiating the electric tones on the basis of the electric signal.

BRIEF DESCRIPTION OF THE DRAWINGS

The features and advantages of the electric stringed musical instrument and the electric stringed musical instrument system will be more clearly understood from the following description taken in conjunction with the accompanying drawings, in which.

DESCRIPTION OF THE PREFERRED EMBODIMENT

Figure 1:
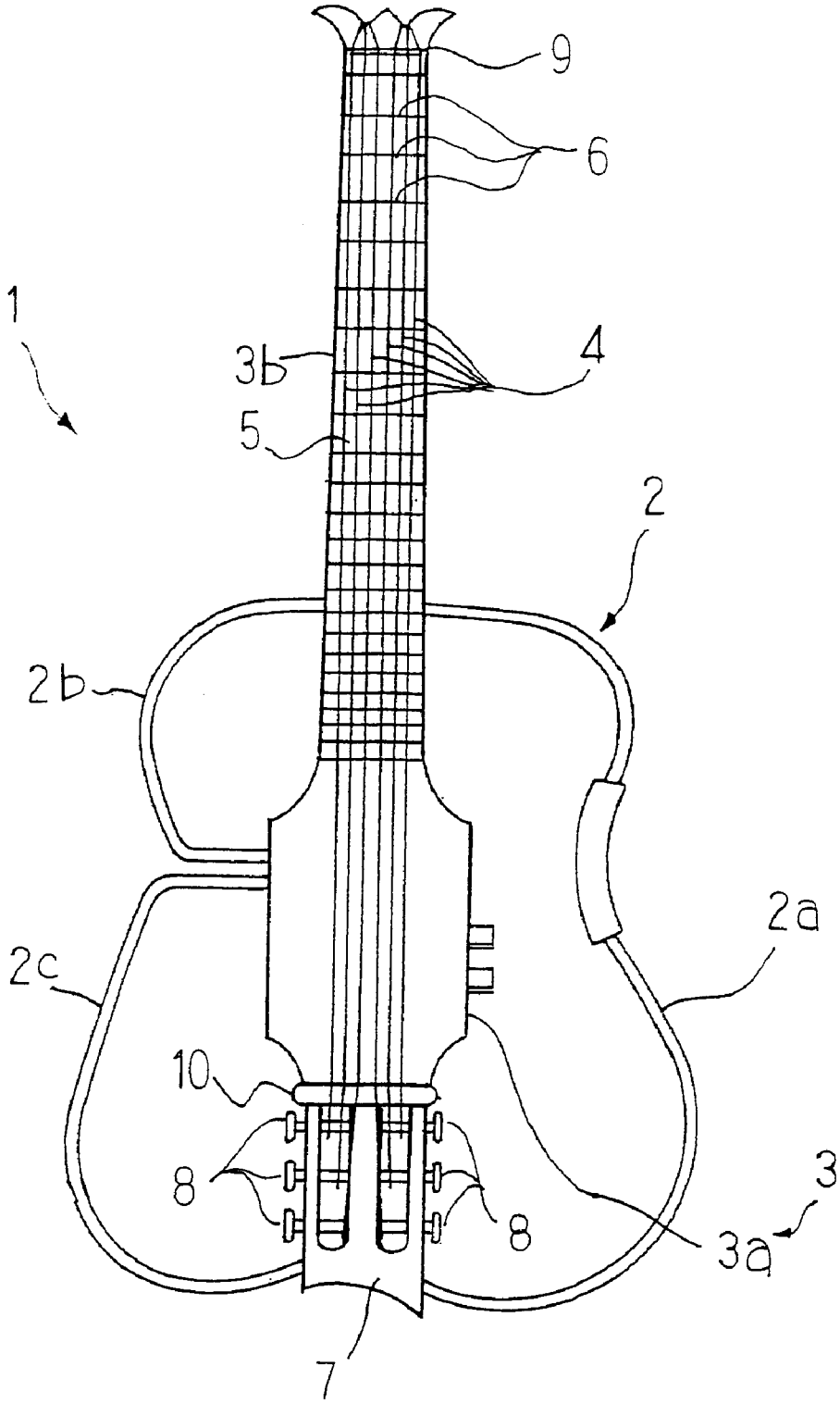
Fig. 1 PRIOR ART
FIG. 1 is a plan view showing the structure of the prior art electric frame guitar.
Figure 2:
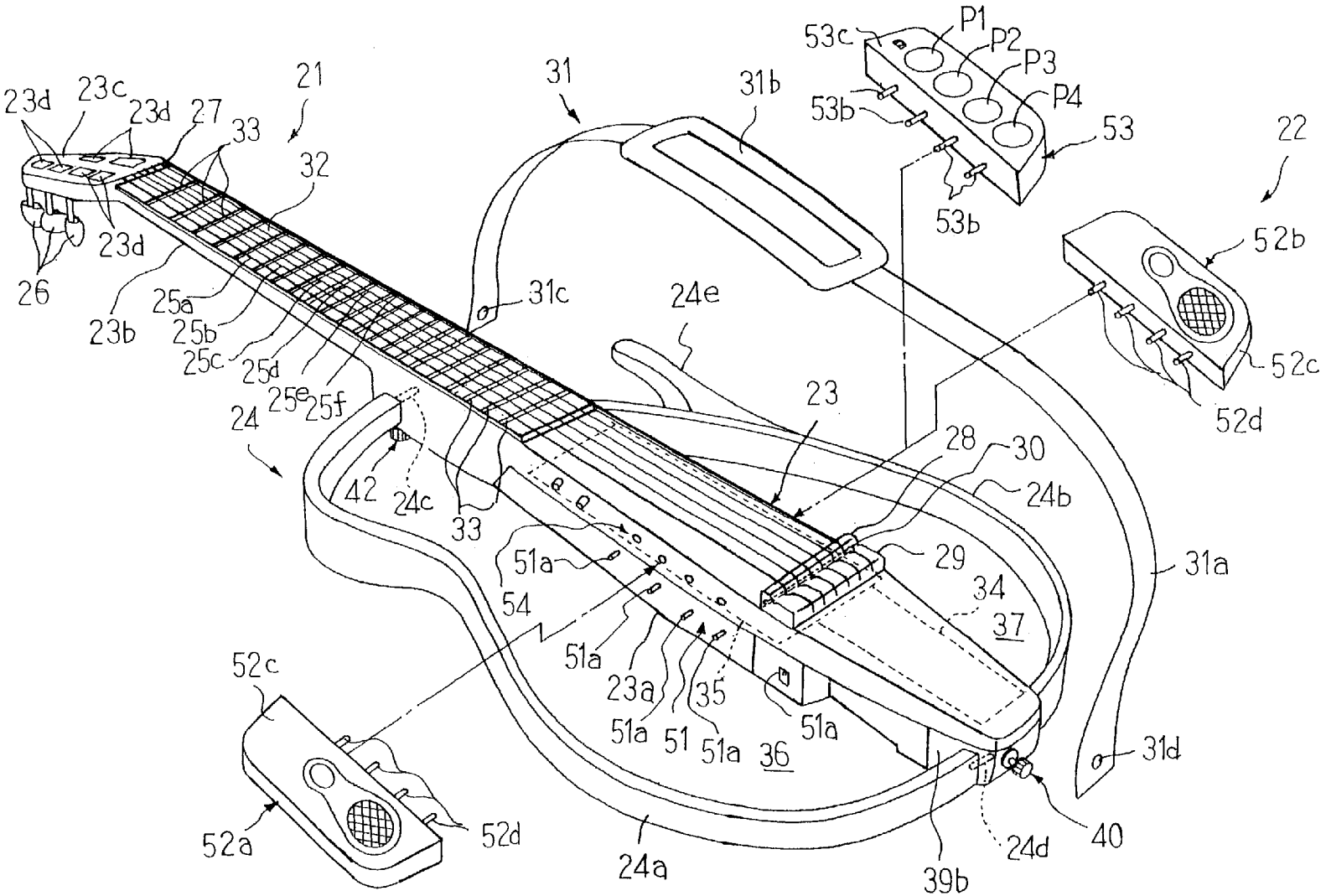
FIG. 2 is a perspective view showing an electric frame guitar and a sound generating system of an electric guitar system disassembled from one another.
Figure 3:
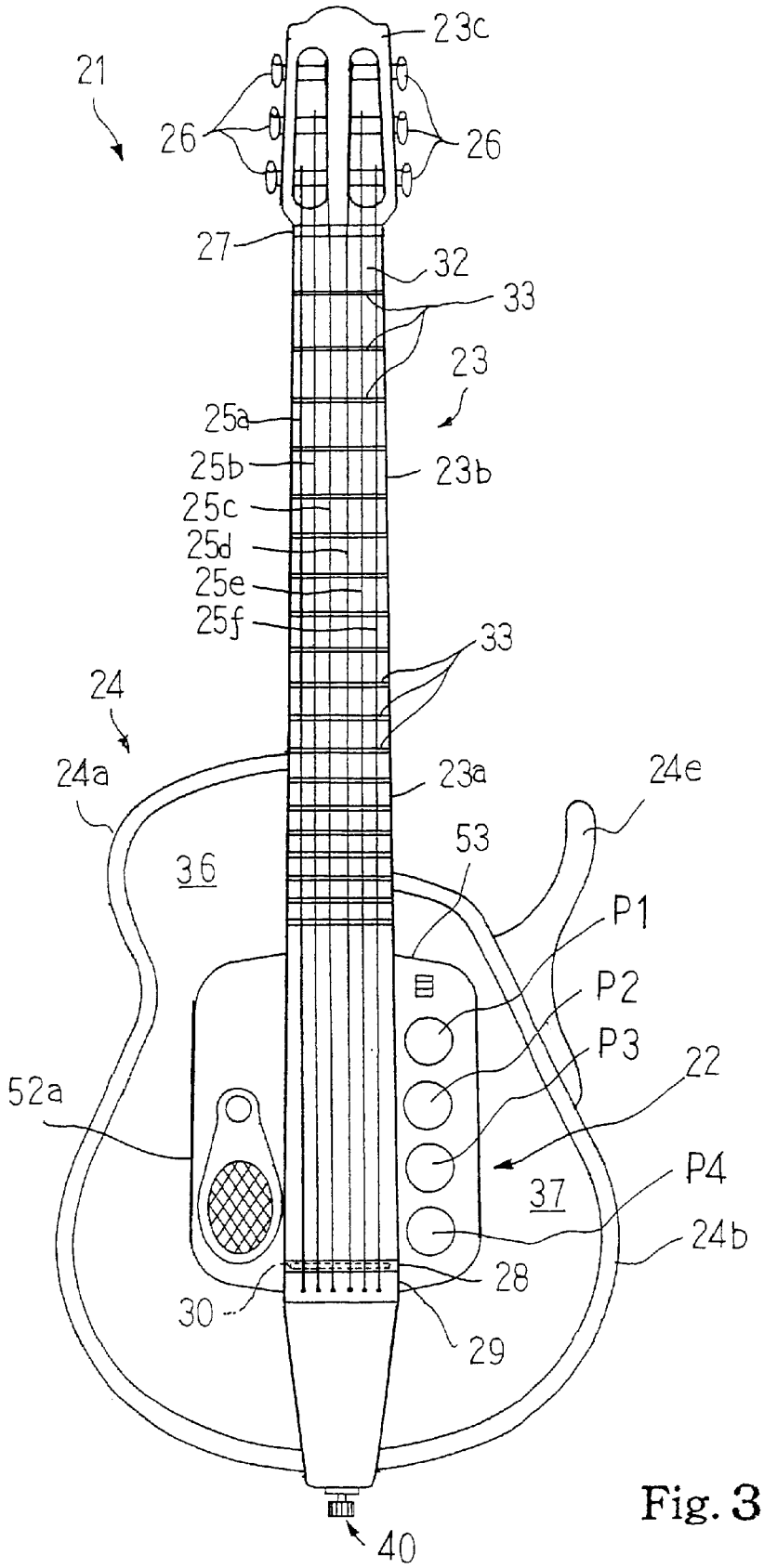
FIG. 3 is a plan view showing the electric guitar system in assembled state.

Referring to FIG. 2, an electric guitar system embodying the present invention largely comprises an electric frame guitar 21 and a sound generating system 22. A guitarist plucks the electric frame guitar 21 and beats it in his or her performance, and the electric frame guitar 21 generates an electric signal representative of tones to be generated and another electric signal representative of beats to be also generated. The electric signals are supplied from the electric frame guitar 21 to the sound generating system 22, and the sound generating system 22 converts the electric signals to the tones and beats. The electric frame guitar 21 is firstly described hereinafter.

The electric frame guitar 21 includes a trunk 23, a frame body 24, six strings 25*a*, 25*b*, 25*c*, 25*d*, 25*e* and 25*f*, pegs 26, bridges 27/28, a tailpiece 29, a pickup 30 and a strap 31. The trunk 23 is made of wood, and is partially thick and partially thin. The thick portion is referred to as "boss", and the boss is labeled with reference "23*a*". On the other hand, the thin portion is referred to as "neck", and the neck is labeled with reference "23*b*".

The neck 23*b* has an upper surface substantially coplanar with the upper surface of the boss 23*a*, and a leading end portion 23*c* of the neck 23*b* is downwardly bent from the remaining portion of the neck 23*b*. Six holes 23*d* are formed in the leading end portion 23*c*, and the pegs 26 are rotatably supported in the holes 23*d* by the leading end portion 23*c*. A fingerboard 32 is adhered to the upper surface of the remaining portion of the neck 23*b*, and the bridge 27 is embedded in the neck 23*b* at the boundary between the leading end portion 23*c* and the remaining portion. Frets 33 are embedded in the fingerboard 32 at intervals. The frets 33 extend in the lateral direction of the fingerboard 32, and are spaced from one another in the longitudinal direction of the fingerboard 32.

A bridge 28 is embedded in the tailpiece 29, and is exposed to the upper surface of the tailpiece 29. The tailpiece 29 is fixed to the upper surface of the boss 23*a*. The pickup unit 30 is further embedded in the tailpiece 29, and vibrations of the bridge 28 are propagated to the pickup unit 30. The pickup unit 30 may be same as the pickup unit disclosed in Japan Patent Application laid-open No. 2000-267668.

A hollow space is formed in the boss 23*a*, and a battery 34 and a circuit board 35 of the sound generating system 22 are received in the hollow space. The pre-amplifier AM is connected to the pickup 26, and is powered with the battery BA. Dials, switches (not shown) and sockets are provided on the outer surface of the boss 23*a*, and are manipulated by users.

The strings 25*a* to 25*f* are anchored to the tailpiece 29, and extend over the upper surface of the boss 23*a* and the fingerboard 32. The strings 25*a* to 25*f* are connected at the other ends thereof to the pegs 26 so that a user exerts tension on and removes the tension from the strings 25*a* to 25*f* by turning the pegs 26. When the user exerts the tension on the strings 25*a* to 25*f*, the strings 25*a* to 25*f* are pressed to the bridges 27 and 28 at both end portions thereof. However, the strings 25*a* to 25*f* float over the frets 33 between the bridges 27 and 28. The strings 25*a* to 25*f* are different in thickness, and different registers are respectively assigned to the six strings 25*a* to 25*f*. The string 25*a* is the thickest of all, and the lowest register is assigned thereto. The string 25*f* is the thinnest, and the highest register is assigned thereto.

The frame body 24 is made of metal, alloy, synthetic resin or wood, and has a contour like the outline of the rigid body of the prior art electric guitar. In this instance, the frame body 24 is separated into two frame pieces 24*a* and 24*b*. Although the frame piece 24*b* is fixed to the boss 23*a*, the frame piece 24*a* is detachably connected to the boss 23*a*.

The frame piece 24*a* is constricted at the intermediate portion, and plugs 24*c*/24*d* project from both ends of the frame piece 24*a*. The frame piece 24*a* is connected at both ends thereof to the trunk 23, and the remaining portion is spaced therefrom. A hollow space 36 takes place between the side surface of the trunk 23 and the frame piece 24*a*.

On the other hand, the frame piece 24*b* is gently curved, and a grip 24*e* projects from the frame piece 24*b*. The frame piece 22*b* is fixed to the side surface of the boss 23*a*, and is not detachable. The frame piece 24*b* is also connected to both ends thereof to the trunk 23, and the remaining portion is spaced therefrom. Another hollow space 37 takes place between the side surface of the trunk 23 and the frame piece 24*b*.

The strap 31 is popular to guitarists, and various sorts of straps are sold in the market. The strap 31 is one of the standard straps. The strap 31 has a flexible belt 31*a* and a pad 31*b*. Holes 31*c*/31*d* are formed at both end portions of the flexible belt 31*a*. The pad 31*b* is slidable on the flexible belt 31*a* so that the user can adjust the pad 31*b* to his or her shoulder.

The frame piece 24*a* is detachably connected to the side portion of the trunk 23 with the plugs 24*c*/24*d*, and the other frame piece 24*b* is fixed to the other side portion of the trunk 23. The strap 31 is further connected to the rear/reverse surface portions of the trunk 23.

Figure 4:
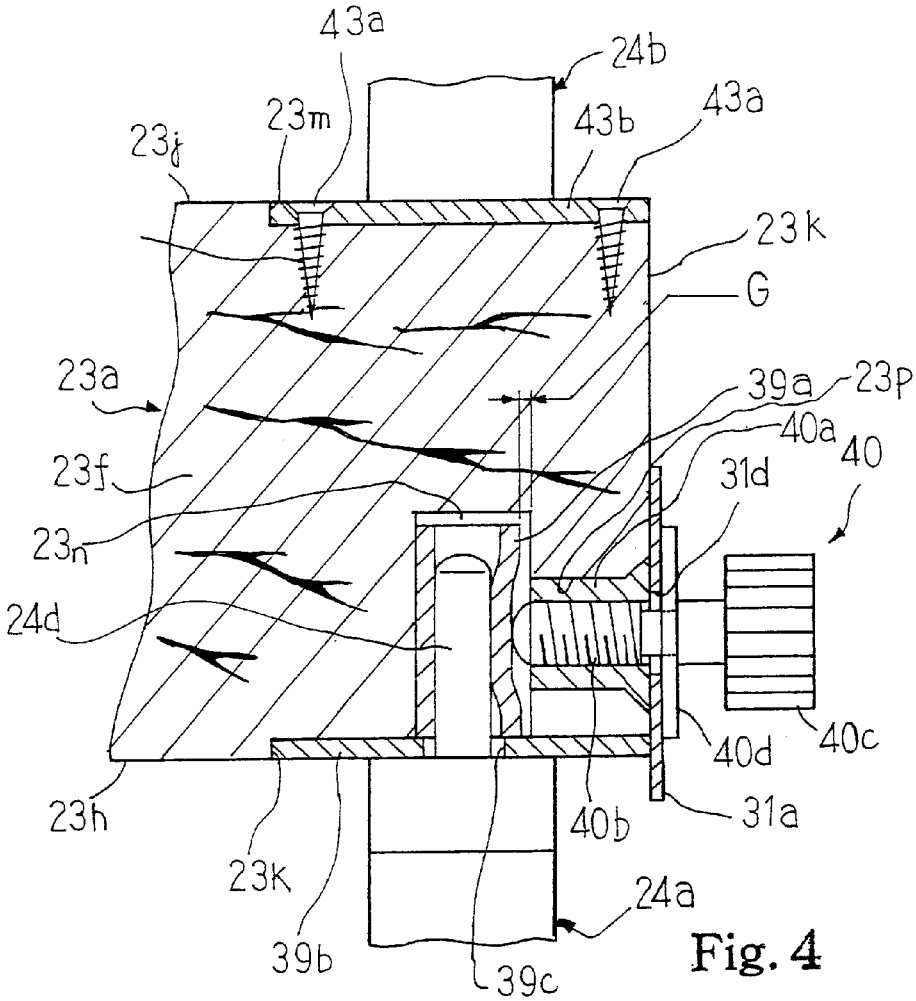
FIG. 4 is a cross sectional view showing frame pieces connected to a trunk.
Figure 5:
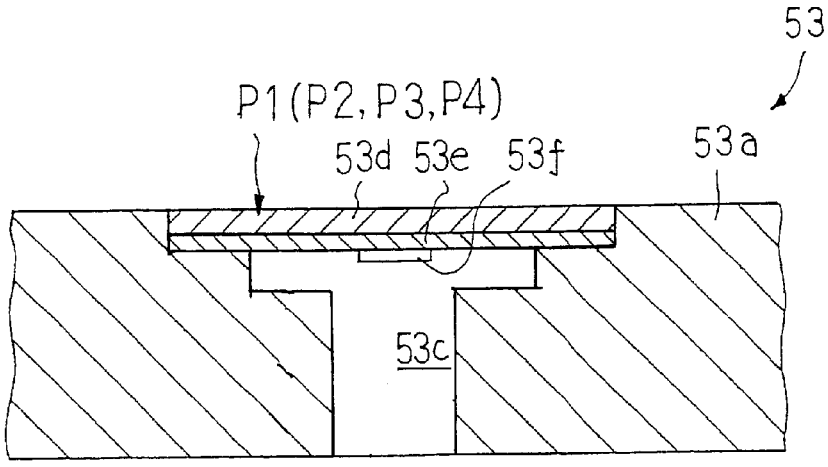
FIG. 5 is a cross sectional view showing a percussion unit incorporated in the electric frame guitar.

FIG. 4 shows the rear end portion 23*f* of the boss 23*a*, to which the frame pieces 24*a*/24*b* and flexible belt 31*a* are connected at the rear ends thereof Since the frame pieces 24*a*/24*b* and flexible belt 31*a* are similarly connected at the other ends to the trunk 23, description is focused on the rear end portion 23*f* The side surfaces, which are respectively close to the strings 25*a* and 25*f*, are designated by reference numerals 23*h* and 23*j*, respectively, and the rear end surface is labeled with reference 23*k*.

The rear end portion 23*f* is partially narrowed so that steps 23*k* and 23*m* take place between the wide sub-portion and the narrow sub-portion. The side surfaces of the narrow sub-portion are generally rectangular. A recess 23*n* is formed in the narrow sub-portion, and is open to the outside on the side surface. A sleeve 39*a* is loosely received in the recess 23*n* so that gap G takes place between the sleeve 39*a* and the inner surface defining the recess 23*n*. The sleeve 39*a* has an inner diameter larger than the outer diameter of the plug 24*d*. This means that the user can easily insert the plug 24*d* into the sleeve 39*a*. The sleeve 39*a* is made of elastically or resiliently deformable material. The sleeve 39*a* of the elastically or resiliently deformable material is to be recovered to the cylindrical shape equal to the gap G after the elastic or resilient deformation.

A generally rectangular plate 39*b* is attached to the side surface of the narrow sub-portion, and is fixed to the narrow sub-portion by means of wood screws (not shown). The generally rectangular plate 39*b* is made of metal or synthetic resin, and has the thickness approximately equal to the depth of the step 23*m*. For this reason, the outer surface of the plate 39*b* is coplanar with the side surface 23*h*. A through-hole 39*c* is formed in the generally rectangular plate 39*b*, and is aligned with the inner space of the sleeve 39*a*. The through-hole 39*c* has the inner diameter smaller in value than the outer diameter of the sleeve 39*a* so that the generally rectangular plate 39*b* prevents the sleeve 39*a* from dropping out from the recess 23*n*. However, the through-hole 39*c* is larger in diameter than the inner diameter of the sleeve 39*a*. The through-hole 39*c* permits the user to insert the plug 24*d* into the inner space of the sleeve 39*a*.

The plug 24*d* and sleeve 39*a* are fastened to the rear end portion 23*f* by means of a fastener 40, and the flexible belt 31*a* is also fastened to the rear end surface 23*k* by means of the fastener 40. Thus, the fastener 40 is shared between the frame piece 24*a* and the flexible belt 31*a*.

The fastener 40 includes a nut 40*a*, a bolt 40*b*, a knob 40*c* and a washer 40*d*. A hole 23*p* is further formed in the rear end portion 23*f*, and is open at one end to the recess 23*n* and at the other end to the outside on the rear end surface 23*k*. The nut 40*a* is inserted into the hole 23*p*, and is fixed to the rear end portion 23*f*. The nut 40*a* is equal in length to the hole 23*p* so that the both end surfaces are coplanar with the inner surface defining the recess 23*n* and the rear end surface 23*k*, respectively. The knob 40*c* is formed with serration, which prevents fingers from slippage. The knob 40*c* is fixed to the bolt 40*b*, and the bolt 40*b* is engaged with the nut 40*a*. The user pinches the knob 40*c* with fingers, and drives the knob 40*c* for rotation. Then, the bolt 40*b* deeply projects through the nut 40*a* into the recess 23*n*, and is brought into contact with the outer surface of the sleeve 39*a*. As described hereinbefore, the sleeve 39*a* is elastically or resiliently deformable. When the bolt 40*b* is pressed to the sleeve 39*a*, the sleeve 39*a* is deformed, and is pressed onto the plug 24*d*. Thus, the bolt 40*b* is pressed through the sleeve 39*a* to the plug 24*d*, and prohibits the plug 24*d* from being pulled out.

The holes 31*c* and 31*d* are formed in both end portions of the flexible belt 31*a*. A bolt (not shown) passes through the hole 25*c*, and is engaged with a nut embedded in the reverse surface portion of the trunk 23. The bolt presses a washer (not shown) to the flexible belt 31*a*, and the washer in turn presses the flexible belt 31*a* to the reverse surface of the trunk 23.

Similarly, the bolt 40*b* passes through the hole 31*d*, and the washer 40*d* is pressed to the flexible belt 31*a*. The washer 40*d* presses the flexible belt 31*a* to the rear end surface 23*k*. Thus, the bolt 40*b* not only presses the sleeve 39*a* to the plug 24*d* but also pinches the flexible belt 31*a* between the rear end surface 23*k* and the washer 40*d*. This means that the fastener 40 is shared between the frame piece 24*a* and the flexible belt 31*a*. Only one knob 40*c* is seen around the rear end portion 23*f* of the trunk 23, and the shared fastener 40 makes the outer appearance of the electric frame guitar 21 simple.

The other plug 24*c* is fastened to the reverse surface portion of the trunk 23 by another fastener 42 in a similar manner to the plug 24*d*. The fastener 42 is used for the flexible belt 31*a* as well as the plug 24*c*. The fastener 42 is similar in structure to the fastener 40, and is shared between the plug 22*c* and the flexible belt 31*a*.

The frame piece 24*b* is fixed to the rear end portion 23*f* by wood screws 43*a*. Generally rectangular plates 43*b* are fixed to both ends of the frame piece 24*b*, and are also made of metal or synthetic resin. Bolt holes are formed in the generally rectangular plate 43*b* at the rear end of the frame piece 24*b*, and the generally rectangular plate 43*b* is attached to the narrow sub-portion. The wood screws 43*a* are screwed through the holes into the rear end portion 23*f*, and presses the generally rectangular plate 43*b* to the side surface of the narrow sub-portion. The generally rectangular plate 43*b* has the thickness equal to the depth of the step 23*m* so that the outer surface of the plate 43*b* is coplanar with the side surface 23*j*. Though not shown in the drawings, the other end of the frame piece 24*b* is similarly fixed to the side surface 23*j* of the trunk 23.

The sound generating system 22 includes the battery 34 and circuit board 35. The sound generating system 22 further comprises a switching panel 51, a pair of speaker units 52*a*/52*b* and a percussion unit 53. Although the switching panel 51 is fixed to the side surface of the boss portion 23*a*, the pair of speaker units 52*a*/52*b* and percussion unit 53 are detachably connected to the side surfaces of the boss portion 23*a*. The speaker unit 52*a* is attached to the side surface same as the manipulating panel 51. However, the other speaker unit 52*b* and the percussion unit 53 are selected attached to the other side surface of the boss portion 53*a*.

Various switches 51*a* such as, for example, a power switch, a volume control switch and a balance control switch are provided on the switching panel 51, and a guitarist manipulates these switches 51*a*. Some switches 51*a* are used for changing timbre of beat sound.

The hollow spaces 36/37 are wide enough to receive the speaker units 52*a*/52*b*. The speaker units 52*a*/52*b* include respective cases 52*c*, diaphragms (not shown) and sets of plugs 52*d*. Each set of plugs 52*d* projects from a side surface of the case 52*c*, and the diaphragm is exposed to the upper surface of the case 52*c*. Associated sockets 54 are embedded in the side surface portions of the boss portion 23*a*, and are connected to the circuit board 34. A guitarist inserts the sets of plugs 52*d* into the associated sockets 54. Then, the speaker units 52*a*/52*b* are electrically connected to the circuit board 35.

The percussion unit 52 includes a case 53*a*, pads P1, P2, P3 and P4 and plugs 53*b*. The case 53*a* is made of rigid material such as, for example, metal, alloy or fiber-reinforced synthetic resin, and withstands the hitting power at beats. Plural holes 53*c* are formed in the case 53*a*, and are stepwise decreased in cross section from the upper surface to the lower surface. Each of the pads P1 to P4 has a decorative plate 53*d*, a metal plate 53*e* and a vibration sensor 53*f*. The decorative plate 53*d* and metal plate 53*e* have a disc shape. The metal plate 53*e* is of the order of 1 millimeter thick. The decorative plate 53*d* is tightly attached to the metal plate 53*e* so that the beats give rise to vibrations of the metal plate 53*e*. The vibration sensor 53*f* is implemented by a piezoelectric transducer, and is attached to the reverse surface of the metal plate 53*e*. The piezoelectric transducers 53*f* are electrically connected to the plugs 53*b*.

The decorative plate and metal plate 53*e* are snugly received in the hole 53*c*, and is secured to the case 53*a*. The vibration sensor 53*f* is so small that the case 53*a* is spaced from the vibration sensor 53*f*. Thus, the vibration sensor 53*f* freely vibrates, and converts the vibrations to an electric signal. The percussion unit 53 is so narrow that the hollow space 3 can receive the percussion unit 53 instead of the speaker unit 52*b*.

Users selectively assign timbres of beats to the pads P1 to P4 through the switches 51*a*. A user may assign the timbre of beats generated through the beating of a body of a Spanish guitar with his or her hand to one of the pads P1 to P4, and the timbre of beats tapped on the body with finger nails to another of the pads P1 to P4. Another user may assign a timbre of drum sound to two of the pads P1 to P4 and a timbre of cymbal sound to the remaining pads. Yet another user may assign a timbre of rim shots at the rim of a snare drum to one of the two pads P1 to P4 and a timbre of head shots at the heat of the snare drum to the other pad. Similarly, the user may assign a timbre of cup shots at the cup portion of a hi-hat cymbal to one of the remaining pads and a timbre of flat shots at the peripheral portion of the hi-hat cymbal. Thus, the users arbitrarily assign timbres of beats to the pads P1 to P4.

Figure 6:
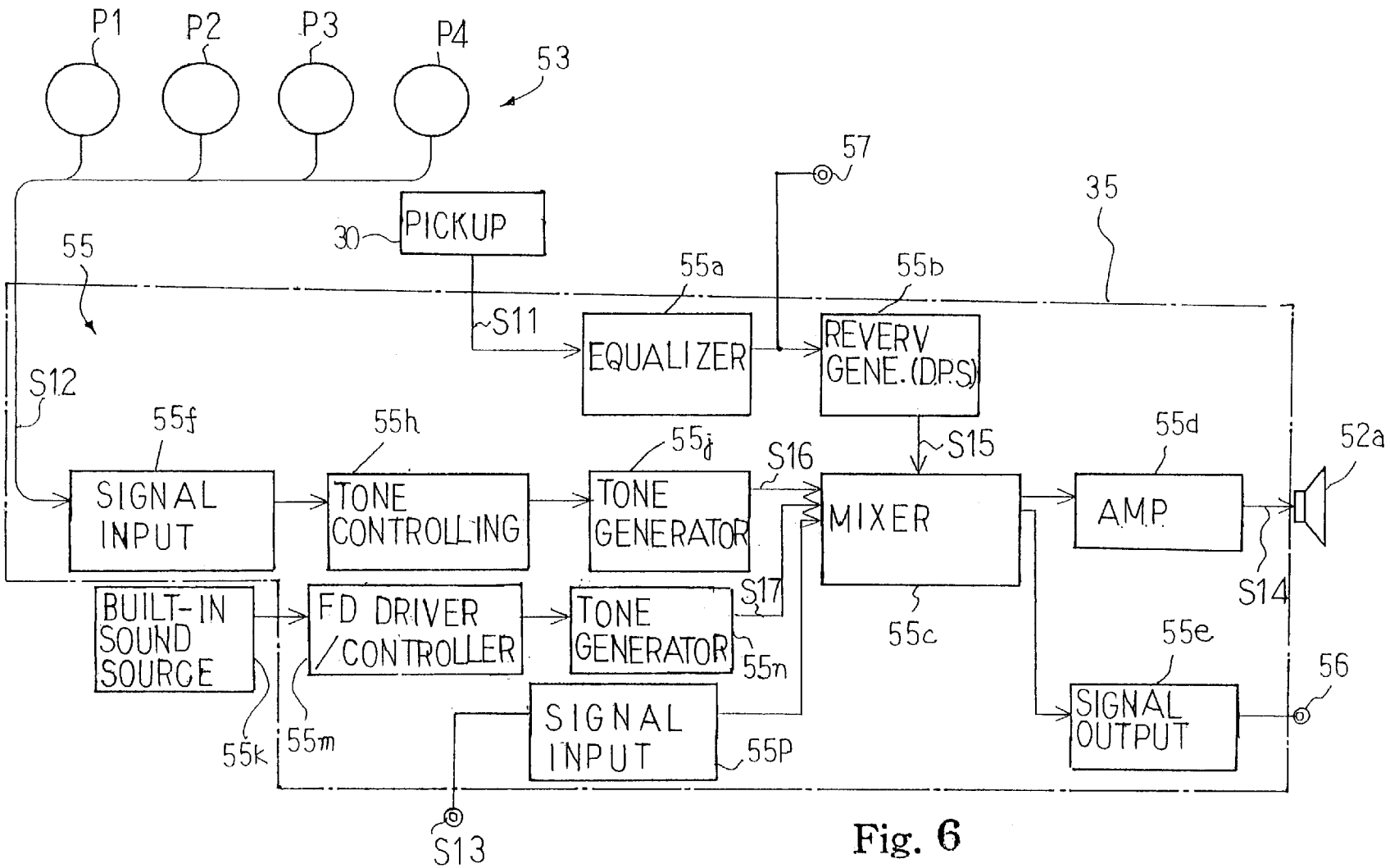
FIG. 6 is a block diagram showing the system configuration of the sound generating system.

Turning to FIG. 6 of the drawings, the circuit board 35 is connected to the pickup unit 30, speaker unit 52*a* and percussion unit 53. A signal processing system 55 is integrated on the circuit board 35. The electric signal S11 representative of the vibrations of the bridge 28 and electric signal S12 representative of the vibrations of the pads P1 to P4 are supplied from the pickup unit 30 and vibration sensors 53*f* to the signal processing system 55. Another electric signal S13 may be further supplied from the external signal source (not shown) to the signal processing system 55. The signal processing system 55 produces a tone signal S14 on the basis of the electric signals S11/S12/S13, and supplies the tone signal S14 to the speaker unit 52*a* or units 52*a*/52*b*. Otherwise, the tone signal S14 from a signal output terminal 56 to an external system.

The signal processing section 55 is broken down into four sections. The first section is assigned to the pickup unit 30, and includes an equalizer 55*a*, a reverb generator 55*b*, a mixer 55*c*, a power amplifier 55*d* and a signal output circuit 55*e*. The electric signal S11 is representative of the vibrations of the bridge 28, and the frequency spectrum is equalized through the equalizer 55*a*. The electric signal S11 is supplied from the equalizer 55*a* to the reverb generator 55*b*. The reverb generator 55*b* includes an analog-to-digital converter, a digital signal processor DPS and a digital-to-analog converter. The electric signal S11 is converted to a series of digital codes, and the digital signal processor processes the digital codes for imparting digital codes representative of the reverberation to the series of digital codes. The digital codes are converted to an electric signal S15, again, and the electric signal S15 is supplied through the mixer 55*c* to the power amplifier 55*d*. In case where the electric signal S12 and/or S13 is supplied to the signal processing system 55, the electric signal S15 is mixed therewith before transmitting it to the power amplifier 55*d*. The power amplifier 55*d* produces the tone signal S14, and supplies it to the speaker unit or units 52*a*/52*b*. Other wise, the mixer 55*c* supplies the signal through the signal output circuit 55*e* to the signal output terminal 56.

The second section is assigned to the pads P1 to P4, and includes a signal input circuit 55*f*, a tone controlling circuit 55*h* and a tone generator 55*j*. While a player is selectively beating the pads P1 to P4, the vibration sensors 53*f* supply the electric signal S12 through the signal input circuit 55*f* to the tone controlling circuit 55*h*. The signal input circuit 55*f* detects the electric signal S12, and shapes the waveform of the electric signal S12. The tone controlling circuit 55*h* is responsive to the electric signal supplied from the signal input circuit 55*f* so as to instruct the tone generator 55*j* the timbre or timbres of beat sound, pitches of the beat sound and duration to be maintained. The tone generator 55*j* fetches pieces of waveform information stored in a memory, and generates a digital tone signal under the control of the tone controlling circuit 55*h*. The digital tone signal is converted to an analog tone signal S16. The analog tone signal S16 is supplied from the tone generator 55*j* through the mixer 55*c* to the power amplifier 55*d* or signal output circuit 55*e*.

The third section is assigned to a built-in sound source 55*k* such as, for example, a compact disc or a floppy disc, and includes a floppy disc driver/controller 55*m* and a tone generator 55*n*. In case where a compact disc serves as the built-in sound source 55*k*, the floppy disc driver/controller 55, is replaced with a compact disc driver/controller. Plural sets of music data codes such as MIDI (Musical Instrument Digital Interface) codes are stored in the floppy disc 55*k*, and the floppy disc driver/controller 55*m* reads out the music data codes. The music data codes are supplied to the tone generator 55*n*, and a tone signal S17 is produced on the basis of the music data codes. The tone signal S17 is supplied from the tone generator 55*n* to the mixer 55*c*.

The fourth section is assigned to the external signal S13, and includes a signal input circuit 55*p*. The external signal S13 is, by way of example, supplied from a compact disc player and/or cassette recorder/player to the signal input circuit 55*p*. The external analog signal S13 is transferred from the signal input circuit 55*p* to the mixer 55*c*.

Thus, the electric signal S15/S13 and tone signals S16/S17 are selectively supplied to the mixer 55*c*, and are mixed into the analog tone signal S14. The analog tone signal S14 is supplied from the mixer 55*c* through the power amplifier 55*d* or signal output circuit 55*e* to the speaker unit or units 52*a*/52*b* or the external system. When a user generates electric tones from an external speaker system, an external power amplifier is connected to the socket 57, and the electric signal is supplied through the socket 57 to the external power amplifier.

The electric frame guitar system according to the present invention is selectively used in at least three modes of operation, which are hereinbelow referred to as "standard electric guitar mode", "percussion-assist mode" and "portable mode".

Neither speaker units 52*a*/52*b* nor percussion unit 53 is connected to the electric frame guitar 21 in the standard electric guitar mode. The frame body 24 and strap 31 are fastened to the trunk 23, and a guitarist slings the electric frame guitar 21 over his or her shoulder. The external power amplifier may be connected to the socket 57. The guitarist selectively plucks the strings 25*a* to 25*f* for his or her performance. If the guitarist does not want to disturb the neighborhood, he or she disconnects the external power amplifier from the electric frame guitar 21. On the other hand, when a guitarist wants to radiate the electric tones from the external speaker system, he or she connects the external power amplifier to the electric frame guitar 21. While he or she is performing a piece of music on the strings 25*a* to 25*f*, the electric signal S11 to supplied from the equalizer 55*a* through the socket 57 to the external power amplifier, and the electric tones are radiated from the speaker system at volume.

When a guitarist wants to perform a piece of music in a certain genre such as, for example, flamenco, classic music or folk music together with percussion sound, he or she connects the percussion unit 53 to the electric frame guitar 21. If the guitarist wishes to generate the electric tones at large volume, he or she further connects the speaker unit 52*a* to the trunk 23 or the external power amplifier to the socket 57. While the guitarist is performing the piece of music, he or she beats the pads P1 to P4, and the percussion sound is generated from the speaker unit 52*a* or external speaker system together with the electric guitar sound.

A guitarist is assumed to play a piece of music on the electric frame guitar 21 at an open-air concert. He or she connects the speaker units 52*a*/52*b* to the trunk 23. While the guitarist is performing the piece of music on the electric frame guitar 21, the vibrating strings 25*a* to 25*f* give rise to vibrations of the bridge 28, and the vibrations are converted to the electric signal S11 by means of the pickup unit 30. The electric signal S11 is equalized, and the signal component representative of the reverberation is given to the electric signal S11. The electric signal S15 is increased in magnitude, and the electric tones are radiated from the speaker units 52/*a*52*b*.

As will be appreciated from the foregoing description, the percussion unit 53 is attached to the electric frame guitar so that the guitarist generates the percussion sound together with the electric guitar sound. Although the electric frame guitar 21 does not have any mechanical resonator, the guitarist can perform pieces of music as if he or she plays them on a Spanish guitar or classic guitar. In the embodiment described hereinbefore in detail, the percussion unit 53 is detachable. The frame body 24 is further separable from the trunk 23. Thus, the detachable percussion unit 53 and separable frame body 24 enhance the portability of the electric frame guitar system.

Moreover, the speaker units 25*a*/25*b* are connected to the electric frame guitar 21 so that the users perform the pieces of music without any bulky sound/speaker system. In the above-described embodiment, the speaker units 52*a*/52*b* are detachable. The frame body 24 is further separable from the trunk 23. Thus, the detachable speaker units 52*a*/52*b* and separable frame body 24 enhance the portability of the electric frame guitar system.

The plugs 52*d* of the speaker unit 52*b* are same as the plugs 53*b* of the percussion unit 53. This results in that the sockets 54 are shareable between the percussion unit 53 and the speaker unit 52*b*. This means that the percussion unit 52*a* and the percussion unit 53 are concurrently available for the performance. The interface between the electric frame guitar 21 and the percussion unit/speaker unit 53/52*b* offers a wide variety of usage to the users.

Although particular embodiments of the present invention have been shown and described, it will be apparent to those skilled in the art that various changes and modifications may be made without departing from the spirit and scope of the present invention.

The present invention is applicable to another electric stringed musical instrument and electric stringed musical instrument system such as, for example, electric base.

For example, the frame piece 24*b* may be also connected to the trunk 23 by means of a coupling mechanism shown in FIG. 4.

The pads P1 to P4 may be increased or decreased. Only one pad or more than four pads are incorporated in the percussion unit.

A circuit board 35 may be deleted from an electric frame guitar according to the present invention. In this instance, the electric signals S11/S12 are supplied from the pickup unit 30 and vibration sensors 53*f* through suitable terminals to an external signal processing system corresponding to the electric signal processing system 55.

Only the first and second sections 55*a*/55*b*/55*c*/55*d*/55*f*/55*h* and 55*j* may be incorporated in the signal processing system 55. This means that the third and fourth sections are deleted from the signal processing system 55.

The signal terminal 57 may be connected between the reverb generator 55*b* and the mixer 55*c*.

Any sort of pickup unit is available for the electric frame guitar. Piezoelectric transducer or transducers may be incorporated in the pickup unit. In case where steel strings are used, an electromagnetic pickup unit will be used for producing the electric signal S11. Optical sensors are also available for the electric frame guitar.

What is claimed is:

1. An electric stringed frame musical instrument for generating electric tones, comprising:

a trunk having a surface;

at least one string connected at both end portions thereof to said trunk, and stretched over said surface;

a frame body connected to said trunk;

a pickup unit provided under said at least one string, and converting vibrations of said at least one string to a first electric signal representative of electric tones to be generated; and an electric percussion unit connected to said trunk, and beaten for generating a second electric signal representative of percussion sound to be generated.

2. The electric frame stringed musical instrument as set forth in claim 1, in which said electric percussion unit has plural pads assigned timbres of percussion sound different from one another.

3. The electric stringed frame musical instrument as set forth in claim 2, in which at least one of said plural pads is assigned a timbre close to the timbre of beats produced through beating an acoustic guitar body provided with a mechanical resonator.

4. The electric stringed frame musical instrument as set forth in claim 2, in which at least one of said plural pads is assigned a timbre close to a timbre of beats produced through beating an acoustic guitar body with a hand, and another of said plural pads is assigned a timbre close to a timbre of beats produced through tapping said acoustic guitar body with finger nails.

5. The electric stringed frame musical instrument as set forth in claim 2, in which at least one of said plural pads is assigned a timbre close to a timbre of beats produced through beating a drum with a stick.

6. The electric stringed frame musical instrument as set forth in claim 5, in which said drum has a rim defining a space and a head stretched over said space, and said timbre is close to the timbre of beats produced through beating said head.

7. The electric stringed frame musical instrument as set forth in claim 5, in which said drum has a rim defining a space and a head stretched over said space, and said timbre is close to the timbre of beats produced through beating said rim.

8. The electric stringed frame musical instrument as set forth in claim 2, in which at least one of said plural pads is assigned a timbre close to a timbre of beats produced through beating a drum with a stick, and another of said plural pads is assigned a timbre close to a timbre of beats produced through beating a cymbal with a stick.

9. The electric stringed frame musical instrument as set forth in claim 1, in which said electric percussion unit is detachable from said trunk.

10. The electric stringed frame musical instrument as set forth in claim 1, in which said frame body and said percussion unit are detachable from said trunk.

11. The electric stringed frame musical instrument as set forth in claim 1, further comprising:

a signal processing system provided inside of said trunk, connected to said pickup unit and at least one vibration sensor of said percussion unit for receiving said first and second electric signals for producing a tone signal representative of said electric tones and said percussion sound to be produced.

12. The electric stringed frame musical instrument as set forth in claim 11, further comprising:

a speaker physically connected to said trunk and electrically connected to said signal processing system for converting said tone signal to said electric tones and said percussion sound.

13. The electric stringed frame musical instrument as set forth in claim 12, in which said speaker is detachable from said trunk.

14. The electric stringed frame musical instrument as set forth in claim 11, in which said signal processing system includes a first section producing a first analog tone signal representative of said electric tones from said first electric signal, a second section producing a second analog tone signal representative of said percussion sound from said second electric signal and an mixer for producing said tone signal from said first and second tone signals.

15. The electric stringed frame musical instrument as set forth in claim 14, in which said first section has a signal terminal for outputting said first tone signal to the outside of said electric stringed frame musical instrument.

16. The electric stringed frame musical instrument as set forth in claim 14, in which said signal processing system further includes a third section for producing a third tone signal representative of other electric tones from pieces of music data information stored in a memory, and said third tone signal is supplied to said mixer so that said tone signal is produced from said first, second and third tone signals.

17. The electric stringed frame musical instrument as set forth in claim 15, further comprising a speaker detachably connected to said trunk and supplied with said tone signal for producing said electric tones and said percussion sound.

18. An electric frame stringed musical instrument for generating electric tones, comprising:

a trunk having a surface;

at least one string connected at both end portions thereof to said trunk, and stretched over said surface;

a frame body detachably connected to said trunk;

a pickup unit provided under said at least one string, and converting vibrations of said at least one string to an electric signal representative of electric tones to be generated; and a signal processing system provided inside of said trunk, connected to said pickup unit for receiving said electric signal, and including a speaker detachably connected to said trunk for radiating said electric tones on the basis of said electric signal.

19. The electric frame stringed musical instrument as set forth in claim 18, in which said frame body has a contour like an outline of an electric stringed musical instrument.

20. The electric frame stringed musical instrument as set forth in claim 18, further comprising an electric power source provided inside of said trunk and supplying an electric power to said signal processing system.

21. The electric frame stringed musical instrument as set forth in claim 18, in which said signal processing system includes a first section connected to said pickup unit for producing a tone signal from said electric signal and supplying said tone signal to said speaker.

22. The electric frame stringed musical instrument as set forth in claim 21, in which said first section has a signal terminal for outputting said tone signal to the outside of said electric frame stringed musical instrument.

23. The electric frame stringed musical instrument as set forth in claim 21, further comprising an electric percussion unit detachably connected to said trunk and producing another electric signal representative of a percussion sound to be produced, said signal processing system further includes a second section connected to said electric percussion unit, producing another tone signal representative of said percussion sound and mixing said another tone signal with said tone signal for producing said percussion sound together with said electric tones through said speaker.

24. The electric frame stringed musical instrument as set forth in claim 23, in which said signal processing system further includes a third section for producing yet another tone signal representative of other electric tones on the basis of pieces of music data information stored in a memory, and said yet another tone signal is mixed with said tone signal and said another tone signal for producing said electric tones, said percussion sound and said other electric tones.

* * * * *